United States Patent [19]

Finnegan

[11] 4,007,565

[45] Feb. 15, 1977

[54] DWELLING MODULE

[76] Inventor: Richard Finnegan, P.O. Box 367, Saratoga, Calif. 95070

[22] Filed: Oct. 29, 1971

[21] Appl. No.: 193,631

Related U.S. Application Data

[63] Continuation-in-part of Ser. No. 838,599, July 2, 1969, abandoned.

[52] U.S. Cl. ..... 52/169.3

[51] Int. Cl.[2] ..... E04B 1/00; E04H 5/00

[58] Field of Search ..... 52/169, 234

[56] References Cited

FOREIGN PATENTS OR APPLICATIONS

| | | | |
|---|---|---|---|
| 809,103 | 7/1951 | Germany | 52/234 |
| 811,400 | 8/1951 | Germany | 52/169 |
| 814,522 | 9/1951 | Germany | 52/234 |
| 228,867 | 12/1924 | United Kingdom | 52/169 |

OTHER PUBLICATIONS

Residential Land Use and Design in California, Trends – Concepts – Innovations by Dept. of Housing and Community Development, State of Calif., Sept. 1968, 21 pages.

American Builder, Mar. 1940, pp. 76, 77.

Architectural Forum, Feb. 1954, pp. 168–171.

The Patio House, Technical Bulletin 45, published by the Urban Land Institute, 1200 8th St., NW. Washington, D.C., 1963, pp. 12, 13, 18, 19, 32, 33.

Progressive Architecture, Aug. 1964, pp. 120, 121, 132, 133, 134.

*Primary Examiner*—Alfred C. Perham

*Attorney, Agent, or Firm*—Townsend and Townsend

[57] ABSTRACT

A family dwelling-land development arrangement with a high building-to-land area ratio including a dwelling module comprising a plurality of individual and separate and spaced apart single family dwellings disposed in a substantially U-shaped configuration about an auto court with an open end adequate to accommodate passage of automobiles. The module includes a plurality of automobile shelters adjacent said dwellings and opening to the auto court to accommodate automobiles passing through the opening to the interior of the configuration.

5 Claims, 4 Drawing Figures

INVENTOR.
RICHARD FINNEGAN
BY Jack M. Wiseman
Thomas C. Schatzel
ATTORNEYS

INVENTOR.
RICHARD FINNEGAN
BY Jack M. Wiseman
Thomas L. Schatzel
ATTORNEYS

INVENTOR.
RICHARD FINNEGAN

BY Jack M. Wyman
Thomas A. Schatzel

ATTORNEYS

DWELLING MODULE

This is a continuation-in-part of application Ser. No. 838,599, filed July 2, 1969 now abandoned.

BACKGROUND OF THE INVENTION

The present invention pertains to land development for individual family dwelling structures. The world population growth is posing serious problems in housing. These problems include housing at costs compatible with various financial income levels of the inhabitants and available land. Land area near populated communities is scarce and requires a high density of building area relative to gross land area while at the same time retaining individuality in the dwellings. In the past, there have been various approaches to this problem. One approach has been the zero lot line principle in which individual dwellings are moved to the side lot line on one side of the lot such that instead of two side yards about the dwelling, there is a solid wall adjoining the adjacent lot and on the other side of the dwelling there is a wider side yard. Though this is an improvement in providing usable land area the density factor is not altered unless smaller lots are utilized. Obviously, the economics of this approach in trying to reduce overall costs while providing better housing is not helped greatly. Another approach has been the "town house concept" in which a plurality of individual single family dwellings are placed in abutting relationship. Though this approach provides for higher housing-to-land area density there is a sacrifice of privacy within the dwellings themselves and to yard areas. Aesthetically, the "town house" generates a row house or apartment appearance.

Also, in present high density communities, the family automobiles remain visible from the public street in many instances. For aesthetic purposes it is frequently desirable that the automobile be removed and not visible from the public highway or from other dwellings. Some approaches taken in the past, such as with "town houses", are to utilize rear alleyways though this results in more land usage.

SUMMARY OF THE PRESENT INVENTION

The present invention provides a family dwelling-land development arrangement including a dwelling module in which the density of family dwellings per unit of land is substantially increased while retaining the individual dwellings in separate spaced apart relationship. Automobile shelters and individual private patio areas are provided for within the module. The automobile shelters and/or patios serve as buffers and separaters for adjacent dwellings while sheltering automobiles on the premises invisible from the public highway and other dwellings.

In an exemplary embodiment, a module is positioned on a land section. The individual dwellings of the module are positioned to assume a format of individual legs forming a first substantially U-shaped configuration about an auto court area. The open end of the configuration provides egress between the auto court area and a public highway adjacent to the land section. A plurality of automobile shelters are positioned within the configuration to open to the auto court area. Each automobile shelter is positioned adjacent to an individual dwelling, thereby forming a smaller second U-shaped configuration interior of the first U-shaped configuration. The individual dwellings are spaced apart from the adjacent dwelling to accommodate a patio area. The individual dwellings of the module may be attached through the shelters and/or fencing. Thus, though the dwellings may be attached to form a common module there is provided individual and spaced apart dwellings for individual families. This provides for privacy to the families in the individual dwellings and at the same time provides for the sheltering of the automobiles at a position which is not visible from the public highway or other dwellings. It further provides for individual private patio area for each dwelling. A further advantage results in that a number of the individual homes in the module may be so positioned as not to face a public highway since only the open end of the configuration need extend to the highway.

The individual modules may be quadrantically arranged in a cluster with the adjacent modules separated by mall structures so as to provide egress to and from the individual dwellings. The modules may be so formed as to provide for a plaza structure within the interior of the cluster adjacent to the modules within the cluster and joining the mall areas. This provides a public recreation and relaxation area isolated from public highways.

Accordingly, the present invention provides a land development arrangement including modules having individual separate and spaced apart single family dwellings at a high building per land area ratio. In other words, the present invention achieves a high degree of land usage heretofore substantially unobtainable with separate single family dwellings. Further economic savings are realized as the cost per dwelling is reduced due to the requirement of less land and the fact that a plurality of dwellings are constructed simultaneously.

The present invention is further advantageous in that it aids in solving the problem of removing the automobiles from the public area. The modules further provide for improved aesthetic values in that only a limited portion, if any, of the dwelling area need face the public highways so that greater use of landscaping and aesthetic architectural features may be made to enhance street appearance and that of the individual dwellings. The individual dwellings are designed so that they may each accommodate an individual private patio area. Within a cluster of the modules, mall areas may be provided so as to accommodate egress to and from the dwelling. The cluster arrangement futher permits provision for a plaza structure for recreation.

DESCRIPTION OF THE PREFERRED EMBODIMENT

Figure 1:
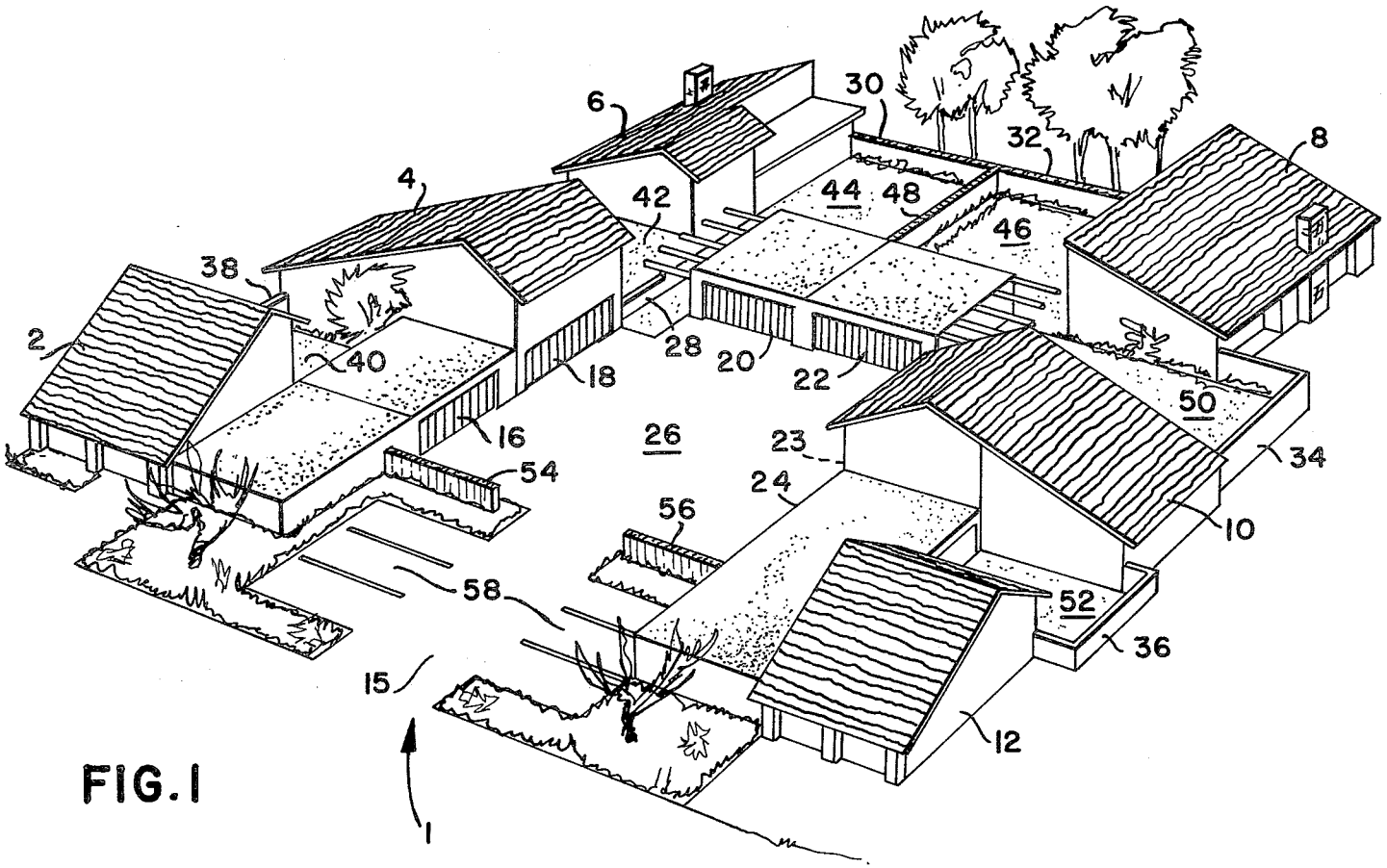
FIG. 1 illustrates in perspective a dwelling module according to the teachings of the present invention.
Figure 2:
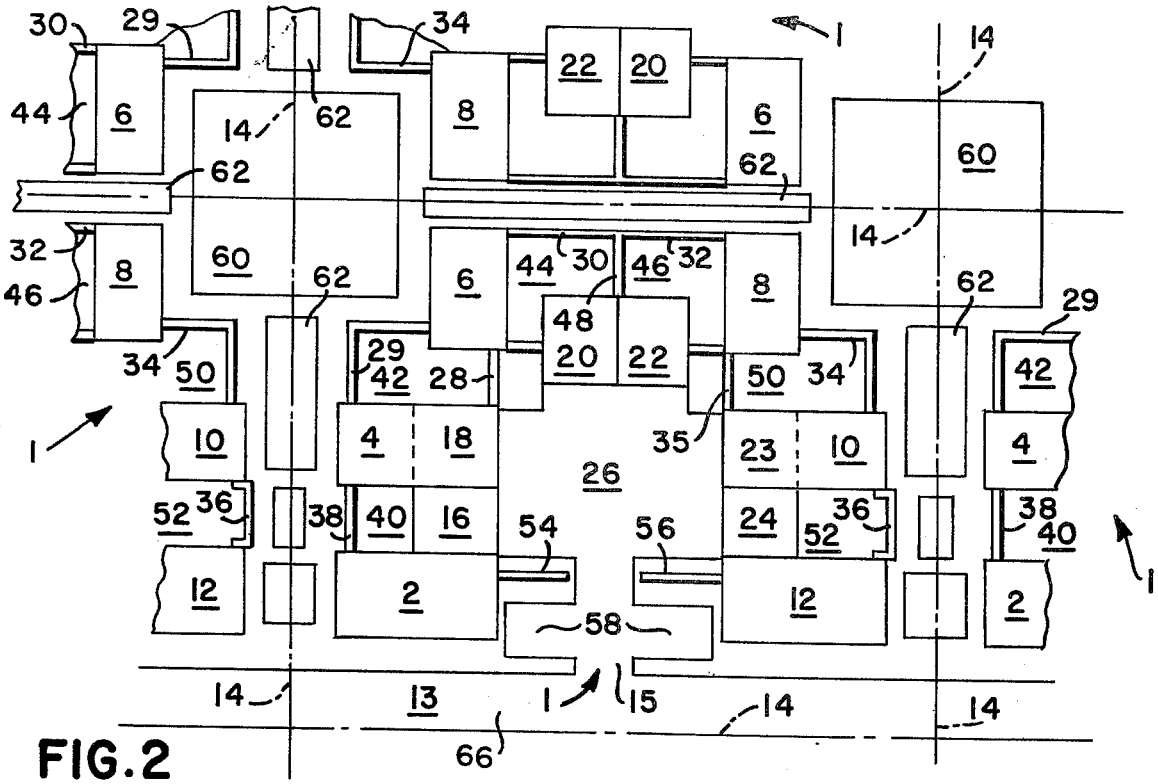
FIG. 2 illustrates diagrammatically a plurality of dwelling modules of FIG. 1 included in combination to form a cluster.

FIGS. 1 and 2 illustrate a dwelling module, referred to by the general reference character 1 and incorporating the teachings of the present invention. The module 1 incorporates six individual single family dwellings 2, 4, 6, 8, 10 and 12. The six individual dwellings are spaced apart in a first U-shaped configuration within a main land section 13 having boundary lines 14. The module format assumes individual legs to form a U-shaped configuration with the dwellings 2, 4 and 6 common to one side leg, the dwellings 8, 10 and 12 common to the second side leg and the dwellings 6 and 8 common to the interconnecting leg. The opening between the side legs provides for a driveway 15 to accommodate the passage of automobiles to and from a public highway. Intermediate the dwellings 2 and 4 is an automobile shelter 16 in the form of a two-car garage. The dwelling 4 is integral with an automobile shelter in the form of a two-car garage 18 abutting the garage 16. Intermediate the dwellings 6 and 8 is a pair of abutting two-car garages 20 and 22. Integral with the dwelling 10 is a two-car garage 23 and intermediate the dwellings 10 and 12 is a two-car garage 24 abutting the garage 23.

The individual garages 16, 18, 20, 22, 23 and 24 all open onto a common area in the form of an automobile court 26 joining the driveway 15. The court 26 serves as a subsection hub area for the module 1 within the boundaries 14 of the main section 13. Thus, each of the garages provides accommodations for automobiles passing through the driveway 15. It is further apparent that the garages 16, 18, 20, 22, 23 and 24 form a smaller second U-shaped configuration interior of the first U-shaped configuration of dwellings. Specifically, garages 16 and 18 form one side leg, garages 23 and 24 form the other side leg, and garages 20 and 22 form the base or interconnecting leg. Thus, the garages provide for buffering and separation of the individual dwellings from one another and from the automobile court 26. It may be noted that the dwellings 4 and 6 are interconnected by means of a fencing segment 28 extending between the shelter 18 and the dwelling 6 and by a fencing segment 29 extending between the dwelling 4 and the dwelling 6. The dwellings 6 and 8 are interconnected by means of a fencing segment 30 and 32 and by means of the garages 20 and 22. The dwellings 8 and 10 are interconnected by means of a fencing segment 34 and a fencing segment 35 joining the garage 22. The dwellings 10 and 12 are interconnected by means of the garage 24 and a fencing segment 36. Likewise, the shelters 2 and 4 are interconnected by means of the garage 16 and by a fencing segment 38.

Further viewing FIGS. 1 and 2 it may be noted that while the individual dwellings are separate and apart though interconnected by the garages and fencing each dwelling also has an individual private patio area. Intermediate the structures 2 and 4 and adjacent to the garage structure 16 is a patio area 40 to accommodate the dwelling 2. Intermediate the dwellings 4 and 6 is a patio area 42 to accommodate the dwelling 4. Intermediate the dwellings 6 and 8 is a pair of patio areas 44 and 46 formed by the fencing segment 30, 32, a common dividing fencing segment 48 and the garages 20 and 22. Intermediate the dwellings 8 and 10 is a patio area 50 to accommodate the dwelling 10 while intermediate the dwellings 10 and 12 is a patio area 52 to accommodate the dwelling 12.

The auto court 26 is further isolated from a public highway by means of decorative walls or fences 54 and 56 extending from the dwellings 2 and 12, respectively, to the driveway 15. Accordingly, the module 1 provides for the individual families of the individual dwellings to shelter their automobiles out of view from the public highways while at the same time maintaining a substantial portion of the sheltering invisible from the public highway. This provides automobile storage, more beneficial use of the public highway while at the same time providing aesthetic advantages to the module 1. It may be further noted that the module 1 may be so positioned as to provide for a parking area 58 for visitors of families within the module.

FIG. 2 illustrates a plurality of modules 1 incorporated in a cluster arrangement according to the present invention. Four of the modules 1 may be arranged quadrantically and a central recreational park or plaza 60 may be provided at the common intersection of the corners of the dwelling modules 1 to form a public recreational area adjoining each of the four modules 1. The modules 1 having a common boundary line 14 are separated from each other by a mall structure 62 having various sidewalk segments and arranged to provide for landscaping intermediate facing legs of adjacent modules 1 within the cluster. As noted, the dwellings 2, 4, 6, 8, 10 and 12 are positioned off of the boundary lines 14 so as to provide for the mall area 62 and the plaza 60. The mall structures 62 further provide access to and from adjacent dwellings and to the park 60.

To illustrate the land-to-building density, the main section 13 of FIG. 2 has dimensions in the order of 130 feet deep and 156 feet in width. The depth also provides for a public highway 66. As illustrated, each dwelling is accommodated by a two-car garage and a private patio. The auto court 26 may be in the order of 44 feet by 48 feet. The dwellings are positioned off of the boundary lines to provide 10 feet between facing legs of adjacent modules and the mall. The corner dwellings 6 and 8 are offset so as to provide for the plaza 60 with dimensions in the order of 62 feet by 64 feet. Thus, while approximately one-half an acre accommodates six dwellings, individuality, privacy, automobile sheltering and public recreation area are retained.

Applicant has found that in accordance with the present invention, the various dimensions thus recited may be varied to achieve more or less spacious arrangements, as economic considerations dictate, without departing from the present invention. Specifically, the dwellings may preferably occupy from 25 to 35% of the main section 13. The garages or automobile shelters may occupy 5 to 20% of the main section while the patios may occupy 10 to 20% thereof. The remaining area is, of course, occupied by the auto court, driveway and common malls and plazas.

Figure 3:
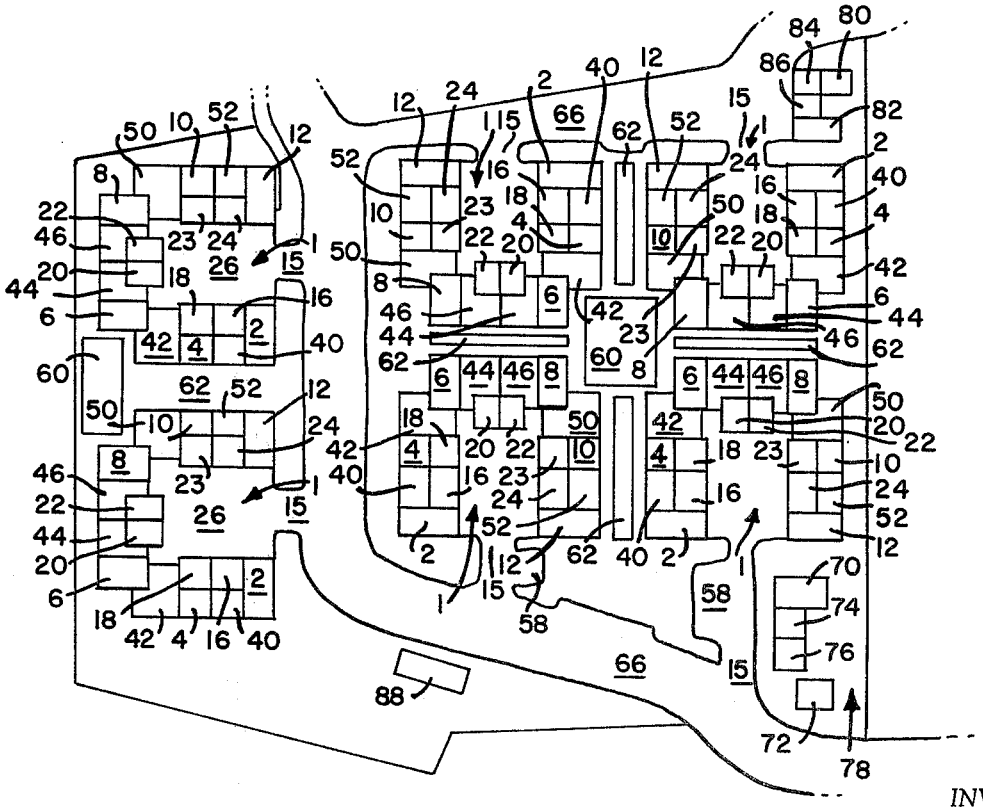
FIG. 3 represents a community development incorporating the individual modules of FIG. 1.

FIG. 3 illustrates a community development comprising an arrangement of which the individual modules 1 are the heart. A large section of land is sectioned to form a plurality of main sections 13. The modules 1 are comprised in combination about the public highway 66 such that the various driveways 15 each extend to the highway 66. As shown, six modules 1 are utilized, four of which are quadrantically arranged to form a cluster according to the present invention. Various other individual segments of the module 1 and individual dwellings may be included to provide for a "non-square" appearance. For example, a module comprising a pair of dwellings 70 and 72 separated by a pair of garages 74 and 76 are added at one end. A driveway 78 extends from the public highway 66 to the garages 74 and 76. A pair of dwellings 80 and 82 separated by a pair of garages 84 and 86 are positioned about another end. The highway winds within the arrangement to provide access to all dwellings. Individual recreational parks 60 are within the interior area away from the public highway while readily accessible from the individual dwellings of adjoining modules. In this particular development there is also provided a public business building 88 with adjacent grounds.

Figure 4:
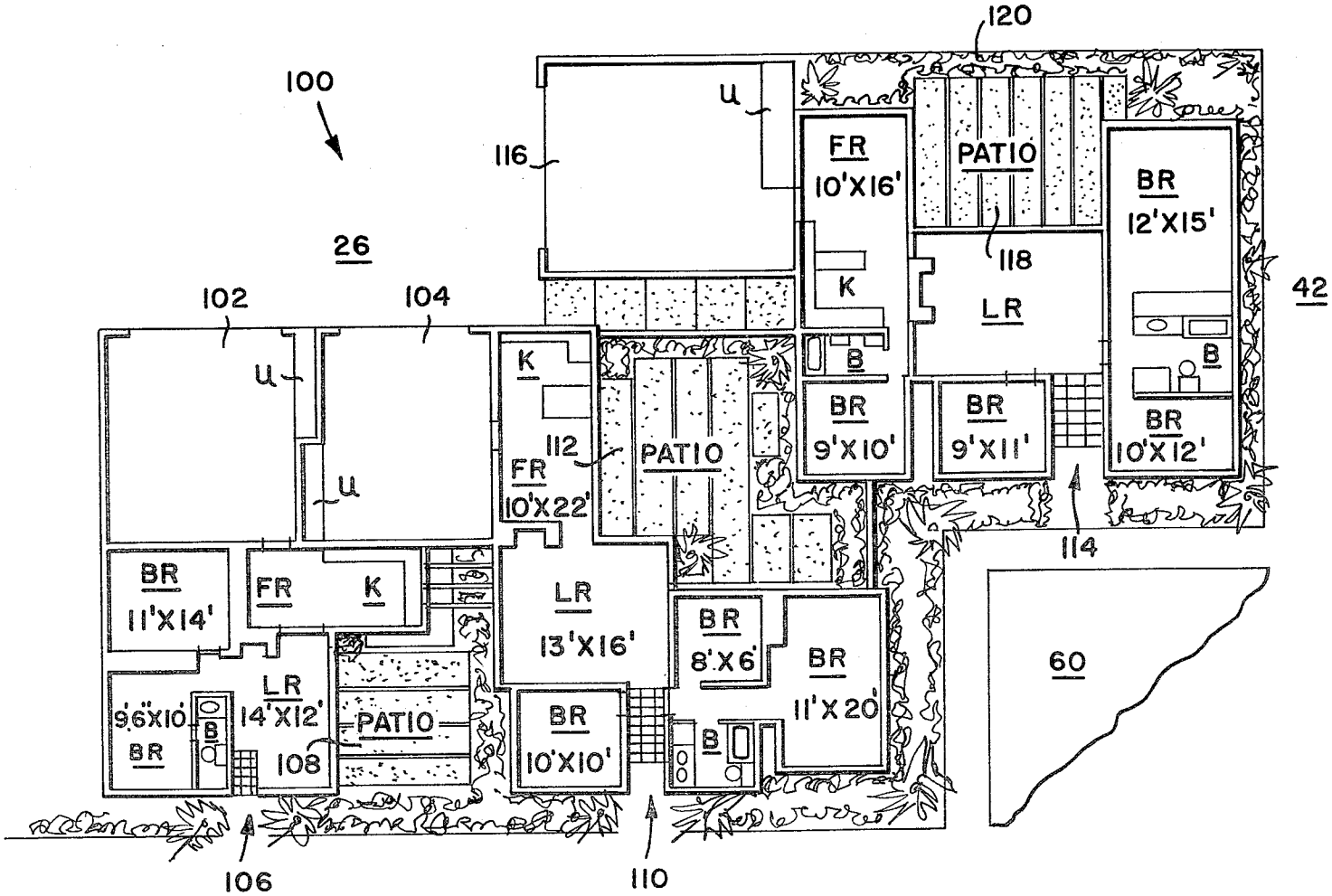
FIG. 4 represents a more detailed diagram of one-half of a module according to the teachings of the present invention.

FIG. 4 diagrammatically illustrates a layout of one-half of a dwelling module, referred to by the general reference character 100, and somewhat modified from that of the module 1. The module 100 may include a complementary segment to that of FIG. 4 to form a six-unit module with six dwellings and six garages. The one-half of the module 100 as illustrated by FIG. 4 extends about the periphery of the auto court 26. There is included a pair of abutting garages 102 and 104. A dwelling 106 adjoins the garages 102 and 104 with the garage 102 accommodating the dwelling 106. As depicted, the dwelling 106 may include two bedrooms (BR), a living room (LR), a family room (FR) and a kitchen (K). A bath area (B) is included as is a utility area (U) opening onto the garage 102. A patio area 108 is formed by the walls of the rooms LR, FR, K and the garage 104. Adjacent to the patio area 108 is a second dwelling 110 adjoined to and accommodated by the garage 104. The dwelling 110 includes a living room (LR), family room (FR), kitchen (K), three bedrooms (BR), a utility area (U) opening onto the garage 104 and a bath (B). A patio area 112 is formed by the walls of the rooms FR, K, LR and two bedrooms BR. Adjacent the patio area 112 is a third dwelling 114 adjoining and accommodated by a garage 116. The dwelling 114 includes a living room (LR), a family room (FR), a kitchen (K), four bedrooms (BR), two baths (B) and a utility area (U) opening onto the garage 116. A patio area 118 is formed by the walls of the rooms FR, LR, one bedroom BR and a fencing segment 120. As illustrated by the drawing of FIG. 4, the dwelling 102 may be in the order of approximately 760 habitable square feet, the dwelling 110 in the order of 1004 habitable square feet and the dwelling 114 in the order of 1132 habitable square feet. To further illustrate, the dimensions of various rooms and patios are shown in feet.

While particular embodiments of the present invention have been described in detail, it is apparent that adaptations and modifications may be made without departing from the true spirit and scope of the invention, as set forth in the claims.

What is claimed is:

1. A cluster of dwelling modules comprising at least four dwelling modules, each of said dwelling modules having a plurality of automobile shelters disposed about in an inner substantially U-shaped configuration defining an automobile court interior thereof having an open end adequate to accommodate passage of automobiles from an auto thoroughfare, said shelters being in substantial abutment to minimize the area of said automobile court, a corresponding plurality of separate and apart family residential dwellings disposed in an outer substantially U-shaped configuration adjacently circumscribing said inner U-shaped configuration, each of said dwellings being disposed adjacent one of said shelters and including front entry means adjacent the exterior of said outer U-shaped configuration, and a walkway circumscribing the exterior of said outer U-shaped configuration and communicating with said front entry means to segregate primary pedestrian access on the exterior of said outer U-shaped configuration from auto access on the interior of said inner U-shaped configuration, four of said modules being disposed adjacent one another in a quadrantical arrangement with a corner of the U-shaped configuration of each module being adjacent the center of said arrangement, the walkways of said modules abutting one another and cooperating to form common malls.

2. The cluster of dwelling modules according to claim 1, wherein each of said modules includes a plaza area at said corner adjacent the center of said arrangement, said plaza areas cooperating to form a common plaza at the center of said arrangement.

3. The cluster of dwellling modules according to claim 1, wherein the open ends of two adjacent modules of said arrangement face in the same direction and the open ends of the other two of said modules face in the opposite direction.

4. The cluster of dwelling modules according to claim 1, wherein for each of said modules said dwellings occupy from 25 to 35% of said module and said shelters occupy from 5 to 20% of said module.

5. The dwelling module according to claim 1 wherein, for each of said modules, said plurality of shelters equal six shelters, the legs of said inner U-shaped configuration each formed by at least an abutting pair of said shelters.

* * * * *